United States Patent [19]

Tsuji et al.

[11] Patent Number: 4,685,539

[45] Date of Patent: Aug. 11, 1987

[54] OPERATING SYSTEM FOR ELEVATOR

[75] Inventors: Shintaro Tsuji; Yasukazu Umeda, both of Inazawa, Japan

[73] Assignee: Mitsubishi Denki Kabushiki Kaisha, Tokyo, Japan

[21] Appl. No.: 879,958

[22] Filed: Jun. 30, 1986

[30] Foreign Application Priority Data

Jul. 4, 1985 [JP] Japan ..... 60-147108

[51] Int. Cl.[4] ..... B66B 1/20

[52] U.S. Cl. ..... 187/126

[58] Field of Search ..... 187/121, 124, 126

[56] References Cited

U.S. PATENT DOCUMENTS 4,298,100 11/1981 Süss et al. ..... 187/126

4,341,288 7/1982 Bass ..... 187/126

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

In an operating system for an elevator wherein operation means are disposed in a plurality of cages, cipher code memory means for storing predetermined operating sequences of the operation means are disposed for the respective cages, and switching means are disposed for comparing operating sequences of the corresponding operation means with the stored predetermined sequences when the operation means are operated and to switch the corresponding cages to predetermined runs when the operating sequences agree; an common cipher code alteration means is provided for altering the stored predetermined operating sequences to different operating sequences for all the cages.

When the cipher code alteration means is manipulated, all the cipher code memory means are commanded to alter their cipher code contents at once, whereby the single altering manipulation suffices to complete the cipher code alterations for all the cages.

8 Claims, 8 Drawing Figures

OPERATING SYSTEM FOR ELEVATOR

BACKGROUND OF THE INVENTION

This invention relates to an operating system for an elevator which is intended to be utilized by only specified people.

In an elevator, when a passenger having gotten into a cage depresses a destination button on an operation panel disposed in the cage, a call is registered, and the cage is run to a floor indicated by the destination button.

In recent years, however, an elevator which can be utilized by only specified people has been required. By way of example, it is desired of an elevator installed in a condominium that only the inhabitants of the condominium and persons permitted to enter by the inhabitants can use the elevator. One system used in such a case, wherein operation buttons are provided separately from destination buttons so that only those who know the predetermined operating sequence of the operation buttons can register calls is described in, for example, the official gazette of Japanese Utility Model Registration application Laid-open No. 57-99875.

When, when the operating sequence of the operation buttons becomes known by outsiders, the usefulness of the system for crime prevention is lost. Therefore, a system wherein the operating sequence can be altered has been proposed in, for example, Japanese Utility Model Registration application Laid-open No. 58-27264.

FIG. 8 is a block circuit diagram showing the prior-art operating system for an elevator disclosed in the Japanese document. In that figure, numerals 1–6 designate cipher code button signals which become a high level, "H" when corresponding cipher code buttons (not shown) arranged on an operation panel within a cage are depressed. A cipher code changeover switch 8 is manually operated. Numerals 9–13 indicate first-fifth cipher code setting circuits respectively, which are connected to the cipher code changeover switch 8 and in which different operating sequences of the cipher code buttons are stored. First-fifth cipher code setting relays 14–18 serve as the output relays of the first-fifth cipher code setting circuits 9–13, respectively.

In such a prior-art operating system for an elevator, assume the cipher code changeover switch 8 is switched to the first cipher code setting circuit 9 and that the first cipher code setting circuit 9 has stored the sequence of cipher code button signals 1→3→5 as the cipher code. Then, when a passenger in the cage operates the cipher code buttons in that sequence to input the cipher code button signals 1, 3 and 5 to the first cipher code setting circuit 9, the output of this circuit becomes "H", the first cipher code setting relay 14 is energized and the elevator is switched to a first specified operation.

If the cipher code changeover switch 8 is switched to the second cipher code setting circuit 10, only when the operating sequence of the cipher code buttons agrees with a sequence set in the second cipher code setting circuit 10 (for example, the sequence of the cipher code button signals 2→4→6), does the output of the second cipher code setting circuit 10 becomes "H" to energize the second cipher code setting relay 15. The elevator is then switched to a second dedicated operation.

In this way, the cipher code is prevented from becoming easily known to outsiders.

In the prior-art operating system for an elevator described above, the cipher code is changed-over for one cage. In a case where a plurality of cages are installed, there is the problem that the cipher codes need to be changed-over for each of the cages, which is troublesome for a person in charge. Another problem is that, since a plurality of changingover manipulations are performed, mistakes are more apt to be made.

SUMMARY OF THE INVENTION

This invention solves the problems described above, and has for its object to provide an operating system for a elevator in which the operating sequences of a plurality of cages can be simultaneously by a single altering manipulation, so the burden on a person in charge is relieved.

The operating system for an elevator according to this invention consists in a system wherein operation means are disposed in a plurality of cages, cipher code memory means for storing predetermined operating sequences of the operation means are provided for the respective cages, and switching means are provided for comparing operating sequences of the corresponding operation means with the stored predetermined operating sequences when the operation means are operated and to switch the corresponding cages to predetermined runs when the operating sequences agree and is characterized by the common disposition of the cipher code alteration means for altering the stored predetermined operating sequences to different operating sequences for all the cages.

In this invention, when the cipher code alteration means is manipulated, commands are given to all the cipher code memory means, and the cipher code contents thereof are simultaneously altered.

BRIEF DESCRIPTION OF THE DRAWINGS

FIGS. 1–7 are diagrams showing an embodiment of an operating system for an elevator according to this invention, in which:

FIG. 1 is a general arrangement diagram;

FIG. 2 is a front view of an operation panel within an elevator cage;

FIG. 3 is a circuit arrangement diagram;

FIG. 4 is a detailed circuit diagram of a cage call registration circuit for cage No. 1 in FIG. 3; and FIGS. 5, 6 and 7 are flow charts showing the operation of decision devices in FIG. 3.

In the drawings, the same symbols indicate identical portions.

DESCRIPTION OF THE PREFERRED EMBODIMENT

FIGS. 1–7 are diagrams showing one embodiment of this invention.

Figure 1:
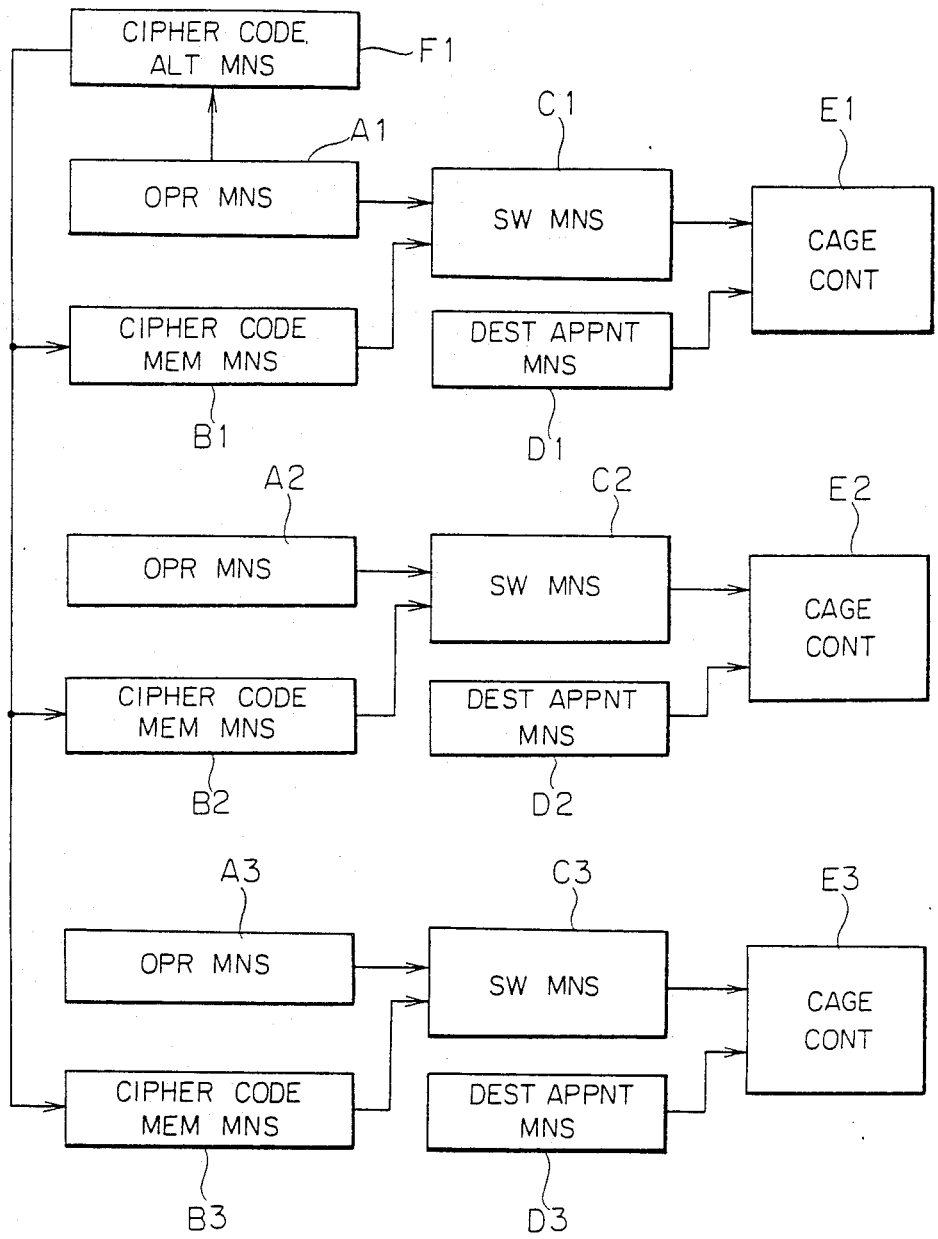

FIG. 1 is a general arrangement diagram, in which symbols A1–A3 denote operation means which are respectively disposed in cages Nos. 1–3 and each of which consists of a plurality of operation buttons. Symbols B1–B3 denote cipher code memory means which are disposed for the respective cages Nos. 1–3 and in which the operating sequences of the corresponding operation buttons are stored beforehand. Switching means C1–C3 deliver command signals for controlling the respective cages Nos. 1–3 in predetermined runs, upon detecting that the operations of the corresponding operation buttons have agreed with the stored operating sequences of the cipher code memory means B1–B3, respectively. Destination appointment means D1–D3 are respectively disposed in the cages Nos. 1–3, and each of them consists of destination buttons for appointing destination floors. Symbols E1–E3 denote well-known cage controllers for the respective cages Nos. 1–3, which control the registration and cancellation of cage calls based on the corresponding destination appointment means D1–D3, the start, travel and stop of the corresponding cages, the setting of traveling directions, the operations of opening and closing doors, etc. Shown at symbol F1 is cipher code alteration means disposed in common for all the cages in order to alter the operating sequences stored in the cipher code memory means B1–B3.

Figure 2:
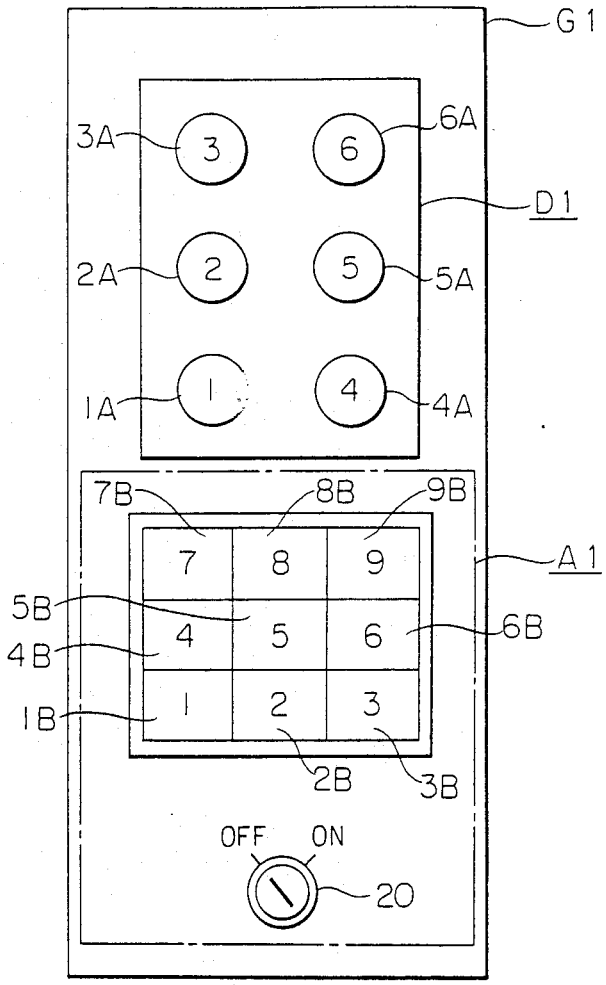

FIG. 2 is a front view of the operation means A1 and destination appointment means D1 of the cage No. 1. Both these means are installed on an operation panel G1 within the cage. The operation panel G1 comprises the destination buttons 1A–6A for the first-sixth floors respectively, a key switch 20 for revising the cipher code, and the first-ninth operation buttons 1B–9B respectively. While the operation panels of cages No. 2 and No. 3 are similarly constructed, they are not furnished with switches corresponding to the key switch 20 for the cipher code revision.

Figure 3:
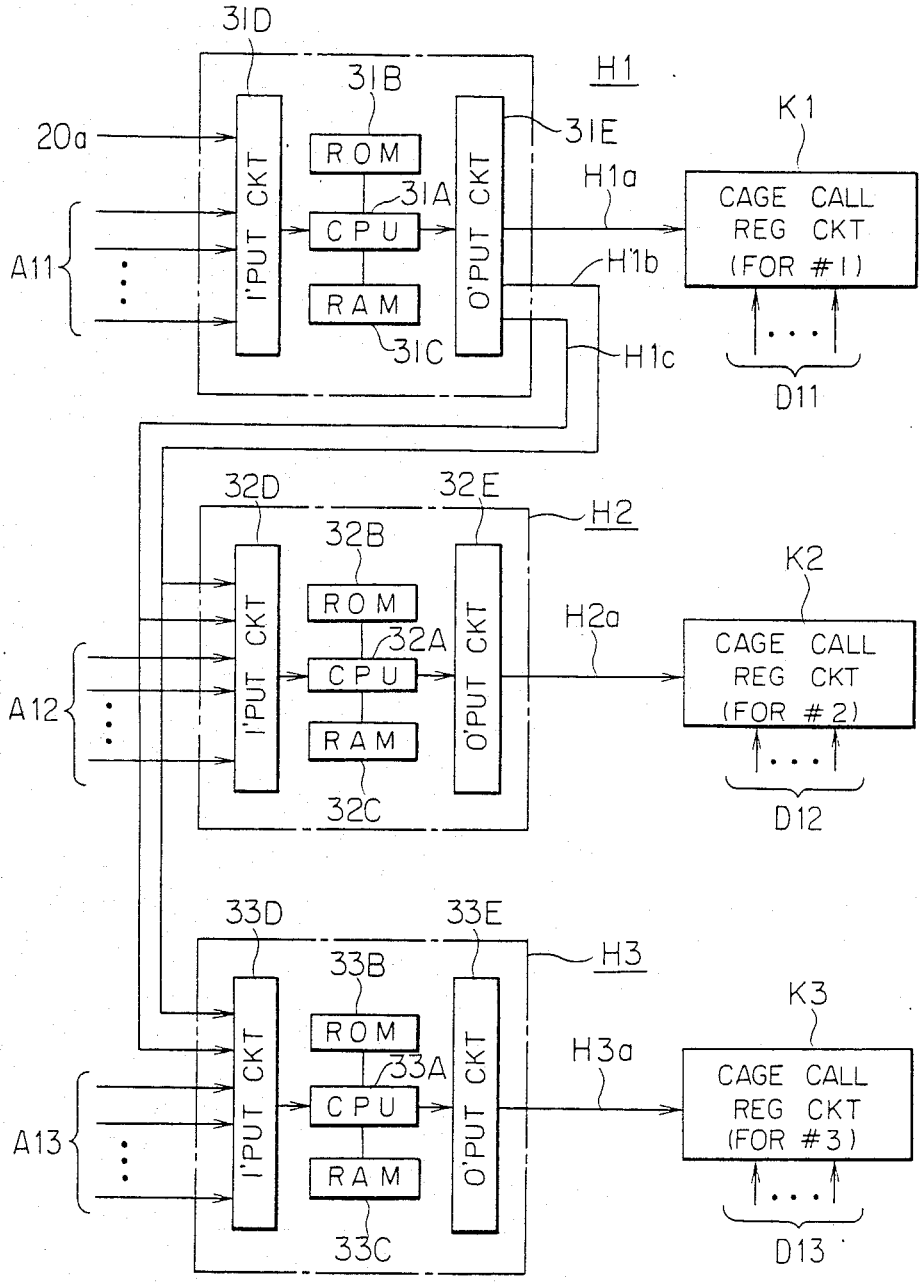

FIG. 3 is a circuit arrangement diagram of the embodiment in FIG. 1. Referring to FIG. 3, symbol 20*a* denotes a revision switch signal which becomes high level, "H" when the key switch 20 is manipulated, and symbols A11–A13 denote operation button signals which are provided from the operation buttons 1B–9B of the cages 1–3 respectively. Decision devices H1–H3 are respectively constructed of microcomputers. The decision device H1 for the cage No. 1 includes the switching means C1 as well as the cipher code alteration means F1, and is constructed of a CPU 31A, a ROM 31B, a RAM 31C (serving also as the cipher code memory means B1), an input circuit 31D and an output circuit 31E. Likewise, the decision devices H2 and H3 for the other cages are respectively constructed of CPU's 32A, 33A, ROM's 32B, 33B, RAM's 32C, 33C, input circuits 32D, 33D and output circuits 32E, 33E (provided that the cipher code alteration means F1 is not included). Cage call registration circuits K1–Ke are respectively disposed in the cage controllers E1–E3 for the cages Nos. 1–3, and they register the cage calls for the first floor-sixth floor in accordance with destination button signals D11–D13 produced by the respective destination appointment means D1–D3 and switching signals H1*a*–H3*a* (to be described below) produced by the respective decision devices H1–H3. The switching signals H1*a*–H3*a* become "H" when the respective cages Nos. 1–3 are enabled to register the cage calls for the sixth floor (assumed a floor to which only specified people can go), and they become a low level "L" at any other time. Symbols H1*b* and H1*c* denote cipher code signals each of which can take values "0"–"9". When the cipher codes are altered to new ones, the values "1"–"9" corresponding to the operations of the operation buttons 1B–9B respectively are output from the decision means H1, and when the cipher codes are not altered, the value "0" is output.

Figure 4:
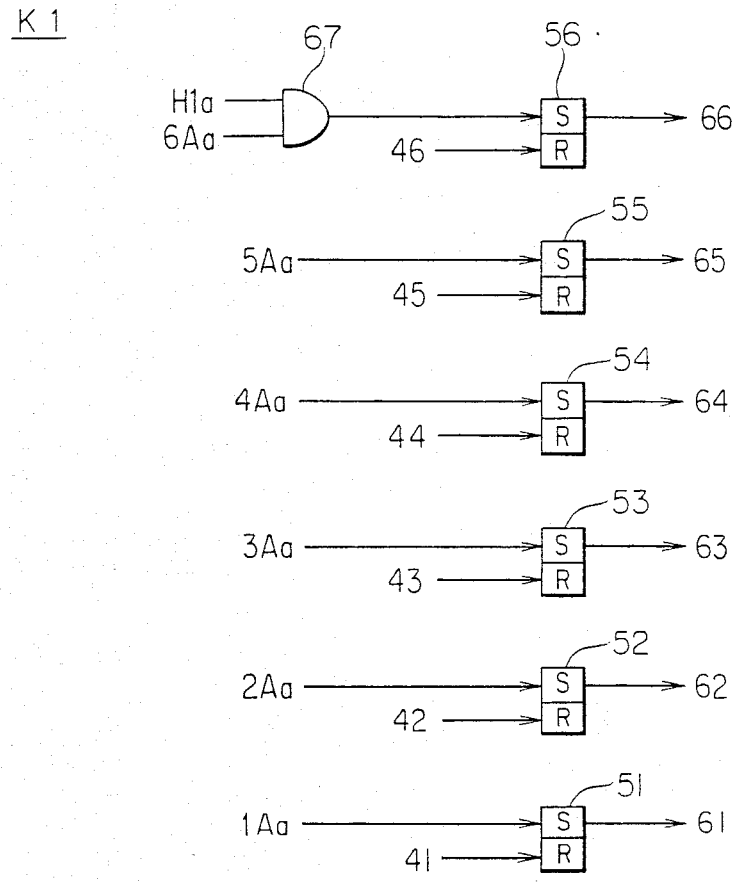

FIG. 4 is a circuit diagram showing the details of the cage call registration circuit K1 in FIG. 3, and the other cage call registration circuits K2 and K3 are similarly arranged. Referring to FIG. 4, symbols 1A*a*–6A*a* denote first floor-sixth floor destination button signals which become "H" when the respective destination buttons 1A–6A for the first floor-sixth floor have been operated, and numerals 41–46 designate first floor-sixth floor cage position signals which become "H" when the cage No. 1 lies on the first floor-sixth floor, respectively. Memories 51–56 are constructed of flip-flop circuits, and the content of each of the memories is set to "H" when the signal of "H" is input to a point S as long as the signal of "H" is not input to a point R, whereas the content is reset to "L" when the signal of "H" is input to the point R. First floor-sixth floor cage call signals 61–66 become "H" when the cage calls for the first floor-sixth floor are registered, respectively. Numeral 67 indicates an AND gate.

Figure 5:
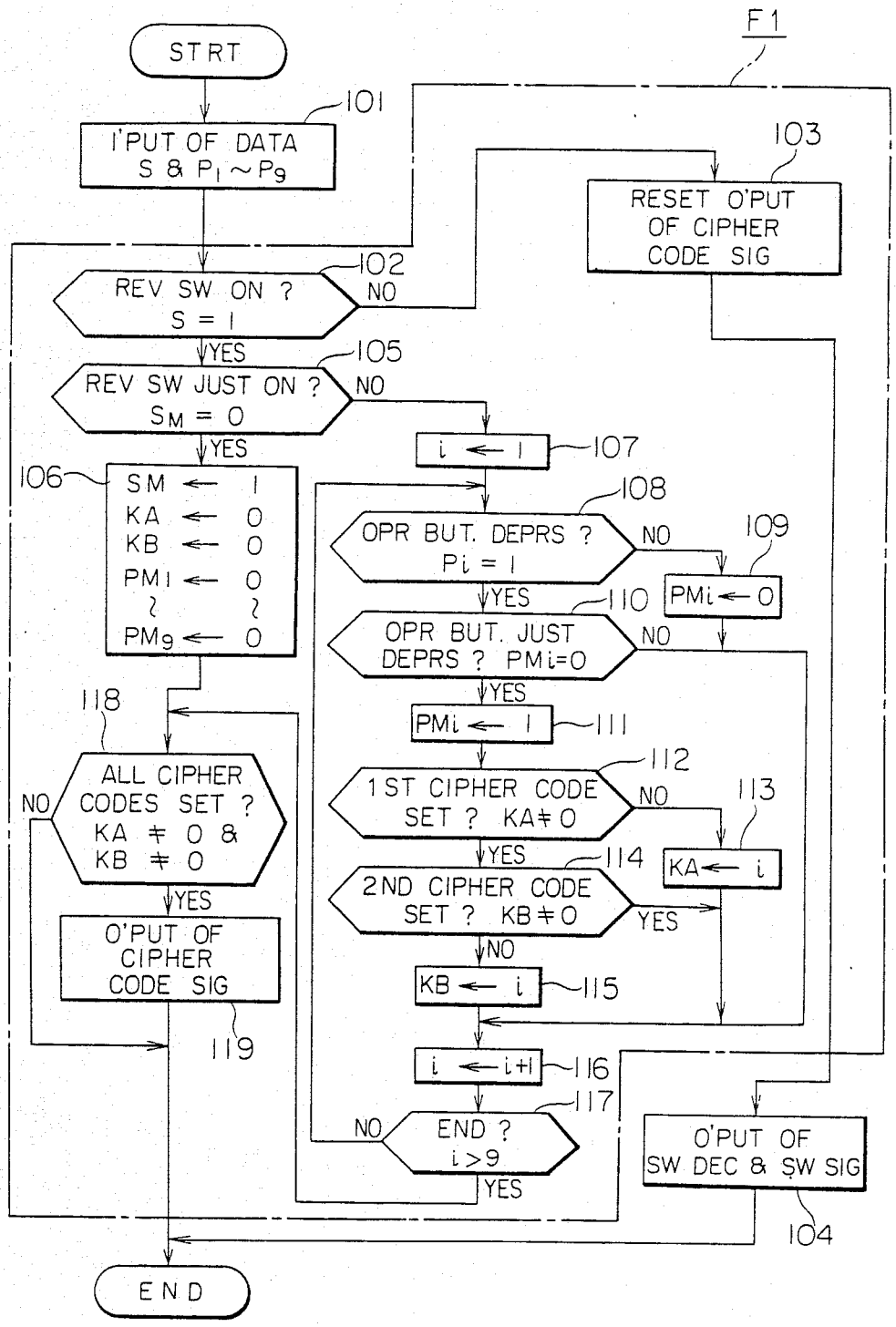
Figure 6:
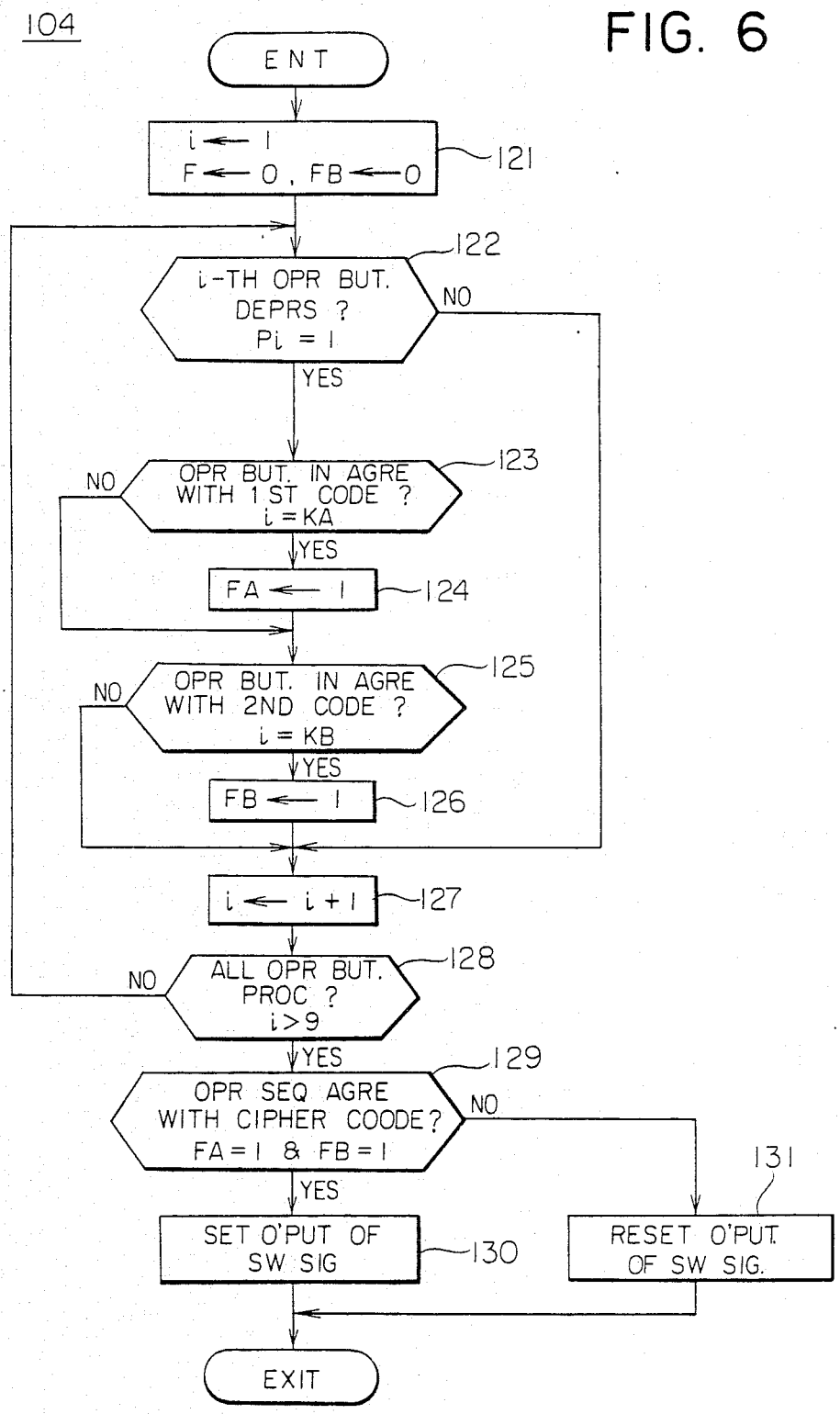
Figure 7:
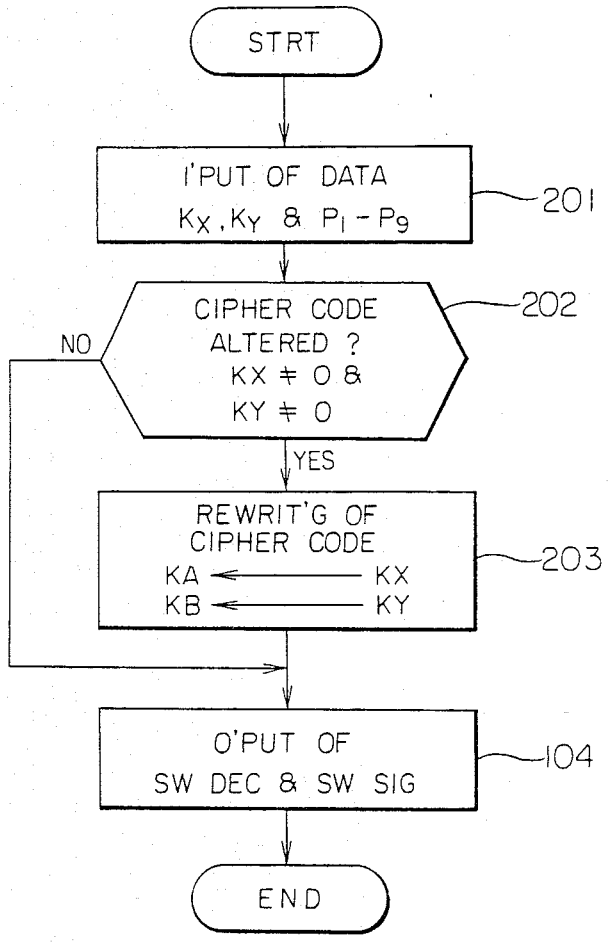
Figure 8:
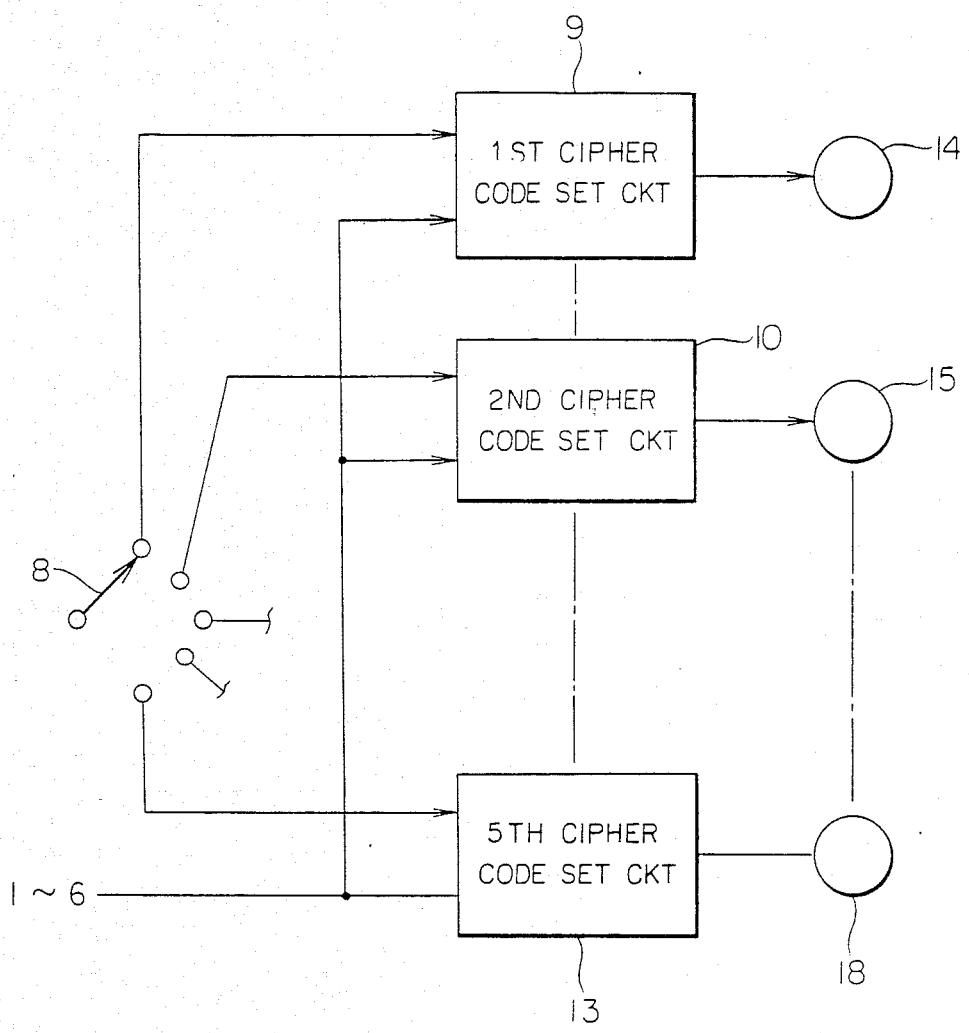
FIG. 8 PRIOR ART
FIG. 8 is a block circuit diagram showing a priorart operating system for an elevator.

FIG. 5 is a flow chart showing a calculation program (a cipher code altering operation) which is stored in the ROM 31B of the decision device H1 for the cage No. 1, FIG. 6 is a flow chart showing a calculation program (a switching operation) which is stored in each of the ROM's 31B–33B of the respective decision devices H1–H3 for the cages Nos. 1–3, and FIG. 7 is a flow chart showing a calculation program (a cipher code storing operation) which is stored in each of the ROM's 32B and 33B of the respective decision devices H2 and H3 for the cages Nos. 2 and 3.

Next, the operation of this embodiment will be described.

It is now assumed that a passenger has gotten into the cage No. 1 on the first floor. When the passenger depresses the destination button 1A for the first floor, the memory 51 remains at "L" because the first floor cage position signal 41 is "H", so that the cage call for the first floor is not registered. In contrast, when the passenger depresses any of the destination buttons 2A–5A for the second floor-fifth floor (only the corresponding one of the second floor-fifth floor destination button signals 2A*a*–5A*a* becomes "H"), the content of any of the memories 52–55 is set to "H" because all the cage position signals 42–45 are "L", so that the cage call for the corresponding destination floor is registered. Next, when the passenger depresses the destination button 6A for the sixth floor, the sixth floor destination button signal 6A*a* becomes "H". Since, however, the switching signal H1*a* from the decision device H1 is ordinarily "L", the output of the AND gate 67 becomes "L" and the cage call for the sixth floor is not registered.

Now consider a case where the passenger has depressed the firth operation button 5B and the eighth operation button 8B at the same time. Steps 101–119 in the calculation program of FIG. 5 are calculated at periods of 0.1 second. At the first step 101, signals are received from the revision switch 20 and operation buttons 1B–9B through the input circuit 31D so as to set revision switch data S and operation button data $P_1$–$P_9$ in the RAM 31C.

The revision switch data S becomes "1" when the revision switch 20 is ON, and becomes "0" when it is OFF. Assuming that the revision switch 20 is OFF, the program proceeds from the step 102 to step 103. At this step, the stored data SM of the revision switch data S is set as "0" in the RAM 31C, and, in order to indicate that the cipher codes are not altered, both the cipher code signals H1*b* and H1*c* are delivered as "0" through the output circuit 31E. At the step 104, whether or not the cage call for the sixth floor is permitted to be registered is decided. This decision step will be described in detail in conjunction with steps 121–131 shown in FIG. 6. At the step 121, operation button No. i (set in the RAM 31C) is initialized to "1", and flags FA and FB (both of which are set in the RAM 31C) indicating whether or not the depressed button has agreed with the cipher codes which are initialized to "0". Thenceforth, the processing of the steps 122–128 is repeated for all the operation button Nos. i=1–9. When the operation button i is not depressed (operation button data $P_i$="0"), this program proceeds from step 122 to step 127, at which the operation button No. i is increased by "1". When the operation button i is depressed ($P_i$="1"), the program proceeds from step 122 to step 123. If, at this step, the depressed button agrees with the first cipher code KA (set in the RAM 31C), the flag FA is set to "1" at the step 124. In addition, if the depressed button agrees with the second cipher code KB (set in the RAM 31C), the flag FB is set to "1" at the step 126, which is followed by the step 127. When the above processing has ended as to all the operation buttons i (i=1–9) at the step 128, whether or not the operating sequence of the operation buttons has agreed with the cipher code is decided at the step 129. If the operating sequence is in agreement with the cipher code (flag FA="1" and flag FB="1") the step 130 sets the switching signal H1*a* to "H" and delivers it through the output circuit 31E, and if the operating sequence is not in agreement, the step 131 resets the switching signal H1*a* to "L" and delivers it.

Accordingly, in a case where the cipher codes KA and KB are respectively set at 5 and 8, the simultaneous depressions of the fifth operation button 5B and the eighth operation button 8B by the passenger provide the operation button data items $P_5$="1" and $P_8$="1", which agree with the cipher codes KA and KB, and hence, the switching signal H1*a* is output as "H" by the step 130. On this occasion, when the passenger depresses the sixth floor destination button 6A simultaneously with the operation buttons 5B and 8B, the switching signal H1*a* becomes "H" and also the sixth destination button signal 6A*a* becomes "H" in the cage call registration circuit K1 of the cage No. 1. Therefore, the output of the AND gate 67 becomes "H", the content of the memory 56 is set to "H" and the cage call for the sixth floor is registered.

In this way, the cage call for the sixth floor cannot be registered by the ordinary depression of the corresponding destination button, but can only be registered when the operation buttons are depressed in accordance with the operating sequence stored beforehand, while the destination button for the sixth floor is depressed.

Next, the operation of altering the cipher codes will be described.

First, when a person in charge closes the revision switch 20 disposed on the operation panel G1 of the cage No. 1, the revision switch data S is set to "1" at the step 101 in FIG. 5, and the program proceeds along the steps 101→102→105. Since the stored data SM is "0" immediately after closure of the revision switch 20, the program proceeds to the step 106. Here, the stored data SM is set to "1", the cipher codes KA and KB are reset to "0", and all the stored data items $PM_i$ (i=1i.e., 9) (set in the RAM 3lC) of the operation button data items P are reset to "0". Assume that the person in charge has depressed the third operation button 3B and ninth operation button 9B in order to alter the cipher codes to "3" and "9". In this case, the program proceeds along the steps 101→ the step 102→105→ the step 107, at which the operation button No. i is initialized to "1". Thenceforth, the processing of the steps 108–117 is repeated for all operation button Nos. i=--1–9-; For the operation button Nos. i=1 and i=2, the operation button data items $P_1$="0" and $P_2$="0" hold. Therefore, the program proceeds along the steps 108→109→116→117, the stored data items $PM_1$ and $PM_2$ are reset to "0" at the step 109, and the operation button No. i is increased by "1" at the step 116. The operation button data $P_3$="1" holds for the operation button No. i=3, and $PM_3$="0" holds immediately after the depression of the third operation button. Therefore, the program proceeds along the steps 108→ the step 110→ the 111, at which the stored data $PM_3$ is set to "1", whereupon the program proceeds to the step 112. Since the first cipher code KA has been reset to "0" at the step 106, the program proceeds along the steps 112→113→116. At the step 113, the first cipher code KA is set as i (=3). The cases of operation button Nos. i=4–8 are similar to the case of operation button No. i=1, and the program proceeds along the steps 108→109→116. The operation button data $P_9$="1" holds for the operation button No. i=9, and $PM_9$="0" holds immediately after the depression of the ninth button. Therefore, the program proceeds along the steps 108→110→111→112. Since the first cipher code KA has already been set to "3" at the steps 112, this step is followed by the step 114→115, at which the second cipher code KB is set to "9". Unless the time is immediately after the depression, the stored data PM has already been set to "1" in spite of the operation button data $P_i$="1", so that the program merely proceeds along the steps 108→110→116.

When the above processing has ended for all the operation buttons i (i=1–9) at the step 117, the step 118 decides whether or not the cipher codes KA and KB have been set. If both have been set, the cipher code signals H1*b* and H1*c* are respectively delivered as "3" and "9" to the decision devices H2 and H3 of the cages Nos. 2 and 3 through the output circuit 31E at the step 119.

Meanwhile, the decision devices H2 and H3 of the cages Nos. 2 and 3 alter the respective cipher codes in accordance with the cipher code signals H1*b* and H1*c*. This operation will be described by taking the cage No. 2 as an example, with reference to the flow chart of the calculation program shown in FIG. 7 (steps 201–203 and 104 are calculated at periods of 0.1 second).

At the first step 201, the cipher code signals H1*b* and H1*c* are received through the input circuit 32D and are set in the RAM 32C as cipher code alteration data items KK and KY. Further, the operation button signals for the cage No. 2 are received to set the operation button data items $P_1$–$P_9$ in the RAM 32C. Assuming that the cipher code alteration data items KX and KY be set at "3" and "9" respectively, the program proceeds along the step 202–the step 203, at which the cipher codes KA and KB are rewritten into the new cipher codes ("3" and "9" ). If at least either of the cipher code alteration data items KX and KY is "0", the cipher codes KA and KB are not altered. The step 104 decides whether or not the cage call for the sixth floor is permitted to be registered, in the same way as described as to the cage No. 1 (FIG. 6).

In the decision device H3 of the cage No. 3, the cipher codes KA and KB are similarly altered.

In this manner, when the manipulation of altering the cipher code is performed in the cage No. 1, the cipher codes of the cages Nos. 2 and 3 are simultaneously altered in interlocking with the manipulation, and hence, the labor of the person in charge can be lightened.

In the case of altering the cipher codes KA and KB in the calculation program of FIG. 5, two of the operation buttons need not always be simultaneously depressed after the closure of the revision switch 20, but the cipher codes KA and KB can be set even when the operation buttons are depressed one by one. Accordingly, the cipher code altering system of this embodiment can be directly applied also to the system in which the operating sequence of operation buttons is compared with a previously stored cipher code to decide the switching of runs. Besides, when the setting of the cipher codes is wrongly input, resetting is permitted by once turning OFF the revision switch 20 and thereafter turning it ON again.

In the above embodiment, when the manipulation of the operation buttons has agreed with the operating sequence stored as the cipher code, the cage call for the specified floor is allowed to be registered and the runs of the cages are controlled accordingly. But the control of the runs of the cages is not restricted thereto. By preparing a plurality of cipher codes, by way of example, it is also possible to change the cage control from an automatic run to a dedicated run or a manual run, the appointment and cancellation of a floor as to which a response to a call is inhibited, etc.

In the embodiment, the operation buttons for inputting or altering the cipher codes have been disposed in the cage separately from the destination buttons for appointing destination floors. However, both the buttons need not always be separated, but the operation buttons may well be used also as the destination buttons. Besides, it is easy to separately dispose operation buttons for inputting cipher codes and those for altering the cipher codes. It is also easy to dipose the operation buttons and switch for altering the cipher codes in an elevator hall, a passageway, etc., namely, not the interior of the cage.

Although, in the embodiment, the cipher codes of all the cages (the three cages) are simultaneously altered by the single manipulation, the code alteration is not retricted to all the cages but the cipher codes of at least two cages may be alterable. Furthermore, the invention is applicable to a case where a plurality of groups, each including at least one cage, are endowed with cipher codes different from one another and are operated to perform individual runs. In this case, common means for altering cipher codes is used with a construction in which it can be switched for the respective groups, whereby a plurality of sorts of cipher code altering manipulations are permitted in one place, and reduction in cost and enhancement in the job efficiency can be expected.

Moreover, the predetermined manipulation of the operation buttons is not restricted to a system in which the plurality of operation buttons are simultaneously depressed as in the embodiment, various systems are considered, such as a system in which the operation buttons are depressed in a predetermined sequence, a system in which the periods of time the operation buttons must be pressed are set at a predetermined length, or a system in which the number of times the operation button is pressed is used as a cipher code. In a system wherein a magnetic card and a magnetic card reader are utilized and wherein a content stored in the magnetic card and a content previously stored in the reader (a cipher code) so as to permit a predetermined run when the contents are in agreement, the invention is applicable to a case of altering the cipher code on the reader side.

As described above, according to this invention, in a system wherein operation buttons are disposed in a plurality of elevator cages, operating sequences of the operation buttons are stored in cipher code memory means provided for the respective cages, and when the operation buttons are operated, the operating sequence thereof is compared with the stored operating sequence to switch the cage to a predetermined run only upon the agreement of the sequences, a cipher code alteration means common to all the cages is provided and the operating sequences stored in the cipher code memory means are altered to different operating sequences by the cipher code alteration means. Thus, the invention allows the operating sequences to be simultaneously altered by the single altering manipulation, reducing the labor of the person in charge.

What is claimed is:

1. In an operating system for an elevator wherein operation means are disposed in correspondence with a plurality of cages, cipher code memory means to store predetermined operating sequences of the operation means beforehand are disposed in correspondence with the respective cages, and switching means are disposed to compare operating sequences of the corresponding operation means with the predetermined sequences stored in the cipher code memory means when the operation means are operated and to switch the corresponding cages to predetermined runs when both the operating sequences agree;

an operating system for an elevator characterized by comprising:

(a) a cipher code revising switch which generates a signal for revising the operating sequences, (b) operation buttons which generate signals for setting the operating sequences, and (c) cipher code alteration means to receive and store the new operating sequence setting signals based on said operation buttons, in response to the revision signal from said cipher code revising switch, and to supply the new operating sequences to the respective cipher code memory means disposed in correspondence with the cages, thereby to alter the stored contents of the operating sequences.

2. An operating system for an elevator as defined in claim 1 wherein said cipher code revising switch and said operation buttons are disposed in adjacency to each other and in the vicinity of one of said operation means disposed in the respective cages.

3. An operating system for an elevator as defined in claim 2 wherein said operation buttons and said operation means are constructed of a keyboard switch in which a plurality of key switches are arrayed, and one of said operation means serves also as the operation switches.

4. An operating system for an elevator as defined in claim 3 wherein when said cipher code revising switch is generating the revision signal, said one operation means functions as said operation switches.

5. An operating system for an elevator as defined in claim 4 wherein said cipher code alteration means updates the contents of said cipher code memory means of the respective cages in response to the operating sequence setting signals generated by said one operation means.

6. An operating system for an elevator as defined in claim 1 wherein said each switching means performs a switching operation of enabling or disabling registration of a call of the corresponding cage for a predetermined floor and enables the registration of the call of the cage for the predetermined floor when the corresponding operation means has been operated in conformity with the predetermined sequence.

7. An operating system for an elevator as defined in claim 6 wherein said operation means is disposed in the corresponding cage and near destination appointment means for registering destination calls in the cage.

8. An operating system for an elevator as defined in claim 1 wherein said cipher code alteration means supplies said each cipher code memory means with a first signal expressing that the operation of altering the stored content is not necessary, when the operating sequence is not being altered, and it supplies said each cipher code memory means with a second signal expressing the new operating sequence, when the operating sequence has been altered.

* * * * *